US007069810B2

(12) United States Patent
Hayashihara

(10) Patent No.: US 7,069,810 B2
(45) Date of Patent: Jul. 4, 2006

(54) PEDAL DEVICE WHEREIN NON-OPERATED POSITION OF OPERATING PORTION IS ADJUSTABLE

(75) Inventor: Takashi Hayashihara, Toyota (JP)

(73) Assignee: Toyoda Iron Works co., Ltd., Aichi-Ken (JP)

( * ) Notice: Subject to any disclaimer, the term of this patent is extended or adjusted under 35 U.S.C. 154(b) by 302 days.

(21) Appl. No.: 10/394,207

(22) Filed: Mar. 24, 2003

(65) Prior Publication Data

US 2004/0040404 A1 Mar. 4, 2004

(30) Foreign Application Priority Data

Aug. 27, 2002 (JP) ..... 2002-246783

(51) Int. Cl.
*G05G 1/14* (2006.01)

(52) U.S. Cl. ..... 74/512

(58) Field of Classification Search ..... 74/512, 74/560; 180/274, 275, 320, 334, 335; 244/235
See application file for complete search history.

(56) References Cited

U.S. PATENT DOCUMENTS

| | | | | |
|---|---|---|---|---|
| 4,875,385 | A | 10/1989 | Sitrin | |
| 5,010,782 | A * | 4/1991 | Asano et al. | 74/512 |
| 5,460,061 | A | 10/1995 | Redding et al. | |
| 5,996,438 | A | 12/1999 | Elton | |
| 5,996,439 | A | 12/1999 | Elton et al. | |
| 6,178,847 | B1 | 1/2001 | Willemsen et al. | |
| 6,324,939 | B1 | 12/2001 | Cicotte | |
| 6,367,348 | B1 | 4/2002 | Toelke et al. | |
| 6,367,349 | B1 | 4/2002 | Allen et al. | |
| 2002/0002874 | A1 | 1/2002 | Burton et al. | |
| 2002/0148322 | A1 | 10/2002 | Gmurowski et al. | |
| 2002/0166408 | A1 | 11/2002 | Willemsen | |
| 2005/0016319 | A1 * | 1/2005 | Kiczek et al. | 74/512 |

FOREIGN PATENT DOCUMENTS

| | | |
|---|---|---|
| FR | 2 739 947 | 4/1997 |
| JP | 2-39216 | 2/1990 |
| WO | WO 02/19051 A1 | 3/2002 |

* cited by examiner

*Primary Examiner*—Chong H. Kim
(74) *Attorney, Agent, or Firm*—Finnegan, Henderson, Farabow, Garrett & Dunner, L.L.P.

(57) ABSTRACT

An adjustable pedal device including (a) a support shaft fixedly disposed on a bracket, (b) a pedal including a pivotal member and a pedal member, and a return spring interposed between the bracket and the pedal member, and wherein the pivotal member is pivotable about the support shaft, while the pedal member is movable relative to the pivotal member to a selected one of a plurality of relative positions, and has at its lower end an operating portion at which the pedal member is operated so that the pedal member and the pivotal member are pivoted together about the support shaft, the return spring biasing the pedal member so as to pivot the pedal about the support shaft in a first direction toward a non-operated position of the pedal, and producing a force of resistance to a pivotal motion of the pedal in a second direction away from the non-operated position when the pedal is operated, and wherein the positions of opposite end portions of the return spring at which the spring is fixed to the bracket and the pedal member are determined such that a length of an arm of a moment produced by the spring to bias the pedal in the first direction changes so as to reduce an amount of change of the force of resistance, as the pedal member is moved relative to the pivotal member.

8 Claims, 3 Drawing Sheets

PEDAL DEVICE WHEREIN NON-OPERATED POSITION OF OPERATING PORTION IS ADJUSTABLE

This application is based on Japanese Patent Application No. 2002-246783 filed Aug. 27, 2002, the contents of which are incorporated hereinto by reference.

BACKGROUND OF THE INVENTION

1. Field of the Invention

The present invention relates in general to a pedal device such as a brake pedal device and an accelerator pedal device, and more particularly to an improved adjustable pedal device wherein the non-operated position of an operating portion of a pedal is adjustable.

2. Discussion of Related Art

There is known an adjustable pedal device having a pedal including (a) a pivotal member which is supported by a bracket such that the pivotal member is pivotable about a support shaft, and (b) a pedal member disposed movably relative to the pivotal member to a selected one of a plurality of relative positions and having at its lower end an operating portion at which the pedal member is operated so that the pedal member and the pivotal member are pivoted together about the support shaft. JP-A-2-39216 discloses an example of an adjustable pedal device of this type for an automotive vehicle, wherein the non-operated position of the operating portion of the pedal member is adjustable in the longitudinal or running direction of the vehicle. The pivotal member is provided with a return spring (a torsion spring) for holding the operating portion of the pedal member at the presently selected non-operated position. When the non-operated position of the operating portion of the pedal member is adjusted, a lever length of the pedal which is a distance between the operating portion and the support shaft is changed, so that a force of resistance to a pivotal motion of the pedal from the non-operated position, which is produced by the return spring, is accordingly changed. To reduce an amount of change of this force of resistance (hereinafter referred to as "depression resistance force of the pedal"), the pedal device uses (i) an adjusting lever which is pivoted when the non-operated position of the pedal member is adjusted, and (ii) an adjusting spring which biases the adjusting lever and which is elongated or contracted with a result of changing its biasing force acting on the adjusting lever, whereby the amount of change of the depression resistance force is reduced.

However, the known adjustable pedal device constructed as described above requires the adjusting lever and the adjusting spring in addition to the return spring, resulting in undesirable increase in the number of the required components and the weight and cost of manufacture of the pedal device, and an undesirable increase in the structural complexity of the pedal device. Further, an electric motor provided to adjust the pedal is required to pivot also the adjusting lever while elongating or contracting the adjusting spring, so that the required size and capacity of the electric motor are increased, resulting in a further increase in the weight and cost of manufacture of the pedal device.

SUMMARY OF THE INVENTION

It is therefore an object of the present invention to provide an adjustable pedal device including a pedal member movable relative to a pivotal member and a mechanism which is arranged to reduce the amount of change of the depression resistance force of the pedal member and which is simple in construction with a reduced weight and economical to manufacture.

The above object may be achieved according to any one of the following modes of this invention, each of which is numbered like the appended claims and depends from the other mode or modes, where appropriate, for easier understanding of technical features disclosed in the present application, and possible combinations of those features.

(1) An adjustable pedal device comprising: (a) a support shaft fixedly disposed on a bracket; (b) a pedal including a pivotal member and a pedal member, the pivotal member being supported by the support shaft such that the pivotal member is pivotable about the support shaft, the pedal member being disposed movably relative to the pivotal member to a selected one of a plurality of relative positions and having at a lower end thereof an operating portion at which the pedal member is operated so that the pedal member and the pivotal member are pivoted together about the support shaft; and (c) a return spring interposed between the bracket and the pedal member and biasing the pedal member so as to pivot the pedal about the support shaft in a first direction toward a non-operated position of the pedal, the return spring producing a force of resistance to a pivotal motion of the pedal in a second direction away from the non-operated position when the pedal is operated at the operating portion, and wherein the return spring is fixed at opposite fixing end portions to the bracket and the pedal member, respectively, positions of the opposite fixing end portions of the return spring relative to the bracket and the pedal member being determined such that a length of an arm of a moment produced by the return spring to bias the pedal in the first direction changes to reduce an amount of change of the above-indicated force of resistance, as the pedal member is moved relative to the pivotal member.

The length of the arm of the moment produced by the return spring to bias the pedal in the first direction toward the non-operated position is a distance between the return spring and the support shaft in a direction perpendicular to a direction in which the return spring biases the pedal (in which the force of resistance indicated above acts on the pedal).

The adjustable pedal device according to the present invention is suitably used as an adjustable pedal device for an automotive vehicle, such as a brake pedal device, a clutch pedal device, a parking-brake pedal device, and an accelerator pedal device. For instance, the pedal device is arranged to mechanically produce an output force or motion, upon operation of the pedal at its operating portion. The output force or motion of the pedal device is transmitted through a suitable power transmitting member such as a rod or cable to a brake booster, a parking brake or a throttle valve, when the pedal is operated at its operating portion. The pedal device may be arranged to push a brake booster rod or pull an accelerator cable or a parking brake cable. However, the output force or motion of the pedal device may be electrically detected to control a desired device such as a throttle actuator, or an electrically operated device in a hydraulic braking system.

In the adjustable pedal device constructed according to the above-described mode (1) of the present invention, the return spring is fixed at its opposite fixing end portions to the bracket and the pedal member, respectively, and the positions of the fixing end portions relative to the bracket and the pedal member are determined such that the moment arm length defined as described above changes so as to reduce the amount of change of the force of resistance to the pivotal motion of the pedal in the second direction away from the non-operated position, as the pedal member is moved relative to the pivotal member. Accordingly, the present pedal device does not suffer from an undesirable change of the force of resistance (hereinafter referred to as "depression resistance force"), which change would be felt by the operator of the pedal when the pedal is depressed at its operating portion by the operator.

Further, a structure or mechanism to maintain the depression resistance force at a substantially constant value irrespective of the relative movement of the pivotal and pedal members is simple in construction with a reduced weight and economical to manufacture. That is, the mechanism is obtained by simply positioning the opposite fixing end portions of the return spring relative to the bracket and the pedal member, respectively, such that the length of the arm of the moment produced by the return spring to bias the pedal member toward the non-operated position changes so as to reduce the amount of change of the depression resistance force. In addition, the change of the length of the arm of the moment reduces the amount of change of the biasing force of the return spring, and is therefore effective to reduce the amount of increase of the resistance to the pivotal motion of the pedal member due to an increase of the biasing force, so that the weight and cost of manufacture of an adjusting device provided to move the pedal member relative to the pivotal member can be significantly reduced. Further, the biasing force of the return spring can be held relatively small, so that the amounts of wear of the related components or portions such as the fixing end portions of the return spring are reduced, so that their required mechanical strength is reduced, and their durability is increased.

(2) An adjustable pedal device according to the above mode (1), wherein the return spring is a tension coil spring.

While a tension coil spring is preferably used as the return spring, it is possible to use as the return spring a compression coil spring, a torsion coil spring and any other springs that bias the pedal such that a distance between the opposite fixing end portions is variable during the operation of the spring. The return spring need not be directly fixed at its opposite fixing end portions to the bracket and pedal member.

(3) An adjustable pedal device according to the above mode (1) or (2), wherein the positions of the opposite fixing end portions of the return spring are determined such that the length of the arm of the moment produced by the return spring changes with a change of a length of the return spring, so as to hold the above-indicated force of resistance substantially constant irrespective of a movement of the pedal member relative to the pivotal member.

Although the positions of the fixing end portions of the return spring may be determined such that the length of the arm of the moment produced by the return spring changes so as to at least reduce the amount of change of the force of resistance, it is desirable to determine the positions such that the length of the arm of the moment changes with a change of the length of the return spring, so as to hold the force of resistance substantially constant irrespective of a change in the relative position between the pivotal and pedal members of the pedal.

(4) An adjustable pedal device according to any one of the above modes (1)–(3), wherein the positions of the opposite fixing end portions of the return spring are determined such that the length of the arm of the moment produced by the return spring increases with an increase of a lever length of the pedal as a result of a movement of the pedal member relative to the pivotal member, the lever length being a distance between an axis of the support shaft and the operating portion of the pedal member.

In the adjustable pedal device constructed according to the above mode (4) of the present invention, the positions of the fixing end portions relative to the bracket and the pedal member are determined such that the length of the arm of the moment defined as described above increases with an increase of the lever length between the support shaft and the operating portion of the pedal member, which increase takes place due to a relative movement of the pivotal and pedal members. This arrangement prevents an undesirable change of the depression resistance force, which change would be felt by the operator of the pedal when the pedal is depressed at its operating portion by the operator.

(5) An adjustable pedal device according to any one of the above modes (1)–(4), further comprising: (d) a guiding device operable to guide a movement of the pedal member relative to the pivotal member along a predetermined path, and (e) an adjusting device interposed between the pedal member and the pivotal member and operable to move the pedal member relative to the pivotal member along the predetermined path, for establishing a desired relative position between the pedal member and the pivotal member, while the pedal member is guided by the guiding device.

In the pedal device according to the above mode (5) wherein the adjusting device is provided to move the pedal member relative to the pivotal member while the pedal member is guided by the guiding device, the weight and cost of manufacture of the adjusting device can be reduced, since the length of the arm of the moment produced by the return spring is changed to reduce the amount of increase of the resistance to the pivotal motion of the pedal member due to an increase of the biasing force of the return spring, as described above with respect to the above mode (1).

(6) An adjustable pedal device according to the above mode (5), wherein the guiding device includes at least one guide piece each of which is fixed to one of the pivotal member and the pedal member such that each guide piece is slidably movable within an elongate slot formed through the other of the pivotal member and the pedal member.

(7) An adjustable pedal device according to the above mode (5) or (6), wherein the adjusting device includes an electric motor fixed to one of the pivotal member and the pedal member, a feedscrew connected to and rotated by the electric motor, and a nut member engaging the feedscrew and fixed to the other of the pivotal member and the pedal member.

The guiding device provided in the adjustable pedal device according to the above mode (5) may include first guide means movable with the pedal member, and second guide means which are movable with the pivotal member and which slidably engages the first means. One of the first and second guide means may be at least one straight or elongate slot as described above with respect to the above mode (6) or at least one guide rail or rod which slidably engages the other of the first and second guide means. Alternatively, one of the first and second guide means may be a parallel link arranged to guide the pedal member. The adjusting device preferably use a screw-and-nut device including a feedscrew rotated by an electric motor, and a nut member which engages the feedscrew, as described above with respect to the above mode (7). Alternatively, the adjusting device may use a rack-and-pinion mechanism, or a chain. While the adjusting device is preferably arranged to continuously change the position of the pedal member, the adjusting device may be arranged to move the pedal member to a selected one of a plurality of positions relative to the pivotal member. Further alternatively, the adjusting device may be a device which is manually operated to establish a desired relative position between the pivotal member and the pedal member. In this case, the pivotal and pedal members may be locked at the manually established relative position with suitable locking means such as screw(s) and nut(s).

(8) An adjustable pedal device according to any one of the above modes (1)–(7), which is to be installed on a vehicle such that an axis of the support shaft is substantially parallel to a lateral direction of the vehicle, and such that the pedal member is movable relative to the pivotal member, in a substantially vertical sliding plane substantially parallel to a longitudinal direction of the vehicle, so that the operating portion of the pedal member is moved in the longitudinal direction.

(9) An adjustable pedal device according to the above mode (8), wherein the positions of the opposite fixing end portions of the return spring relative to the bracket and the pedal member are determined such that the length of the arm of the moment produced by the return spring increases with an increase of a lever length of the pedal as a result of a rearward movement of the operating portion of the pedal member toward a rear side of the automotive vehicle, which rearward movement is caused by a movement of the pedal member relative to the pivotal member, the lever length being a distance between the axis of the support member and the operating portion of the pedal member.

In the adjustable pedal device for a vehicle according to the above mode (8) or (9), the operating portion of the pedal member of the pedal is moved in the longitudinal direction (running direction) of the vehicle. However, the pivotal member and the pedal member of the pedal may be arranged such that the position of the operating portion of the pedal member is adjustable in the vertical direction, or such that the attitude of the operating portion is variable. It is also to be understood that the principle of this invention is applicable to an adjustable pedal device for use on or with any device or equipment other than a vehicle.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

Figure 1:
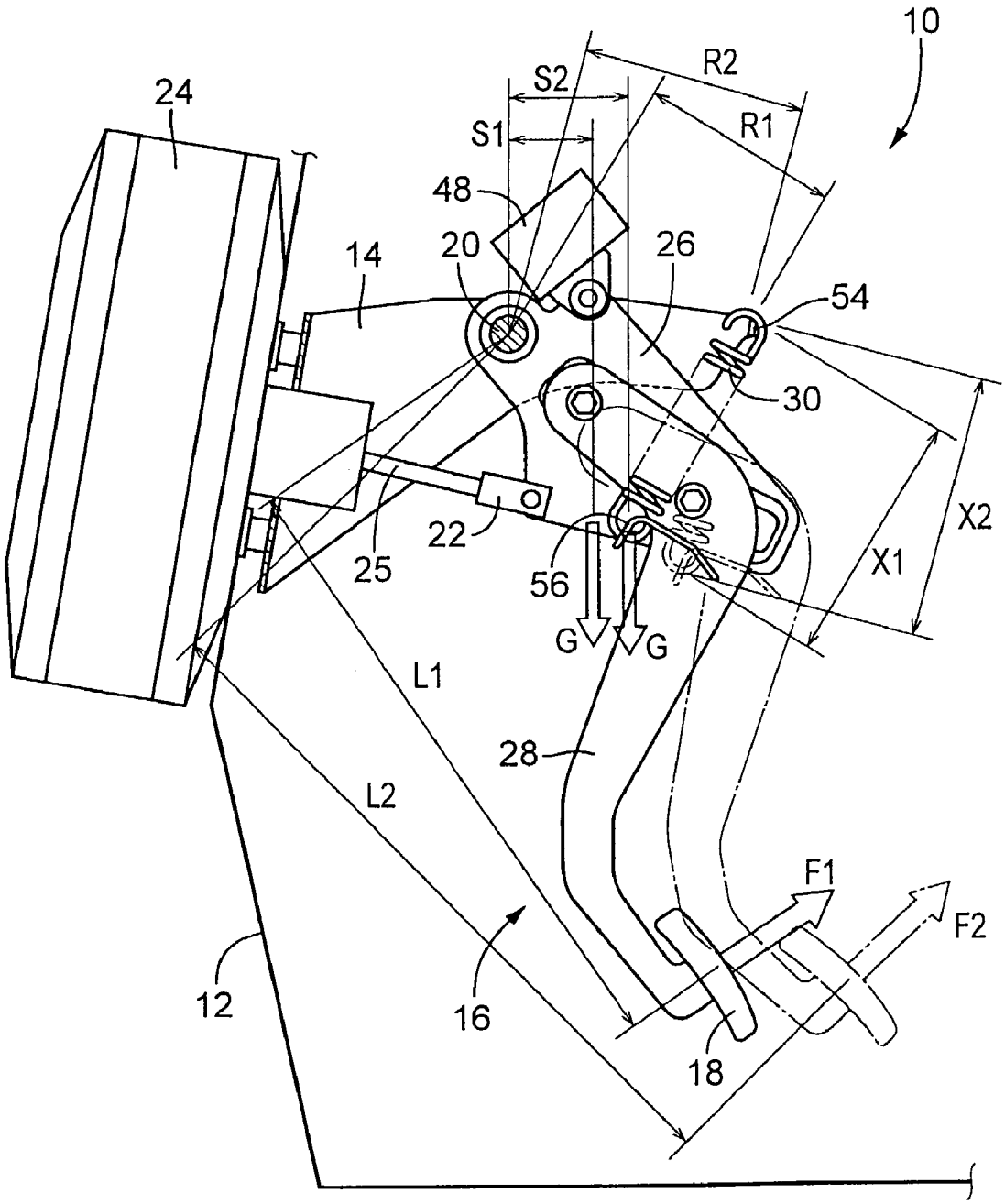
FIG. 1 is a partly cut-away side elevational view of a brake pedal device for an automotive vehicle, which is constructed according to one embodiment of this invention.

Referring to first to the partly cut-away side elevational view of FIG. 1, there is shown an adjustable pedal device in the form of a brake pedal device 10 which is constructed according to one embodiment of this invention and installed on an automotive vehicle. In FIG. 1, the left portion of the view corresponds to the front side of the vehicle, while the right side portion corresponds to the rear side of the vehicle. Namely, a vehicle operator's seat is located on the right side of the elevational view of FIG. 1. The brake pedal device 10 is mounted on a bracket 14 fixed on a body 12 (e.g., a dash panel) of the vehicle, and includes a brake pedal 16 having an operating portion in the form of a pedal pad 18 at its lower end. When the brake pedal 16 is depressed at its pedal pad 18 while the brake pedal 16 is placed at the presently selected non-operated or original position of FIG. 1, the brake pedal 16 is pivoted clockwise (as seen in FIG. 1) about a support shaft 20 fixedly disposed on the bracket 14, so as to push or advance a rod 25 of a brake booster 24, which is connected to the brake pedal 16 through a clevis member 22. As a result of an advancing movement of the booster rod 25, the brake booster 24 is activated to boost an operating force acting on the pedal pad 18 of the brake pedal 16, and apply its output to an input member of a master cylinder (not shown), so that a working fluid in the master cylinder is pressurized by a pressurizing piston to activate a hydraulically operated braking system of the vehicle. In the present embodiment, the rod 25 of the brake booster 24 serves as a power transmitting member for transmitting the operating force of the brake pedal 16 to the brake booster 24. The support shaft 20 is fixed to the bracket 14 such that the centerline or axis of the support shaft 20 is substantially parallel to the horizontal direction and to the lateral or transverse direction of the vehicle (substantially perpendicular to the longitudinal or running direction of the vehicle).

The brake pedal 16 consists of upper and lower members in the form of an upper pivotal member 26 and a lower pedal member 28. The pivotal member 26 is supported by the support shaft 20, pivotablly about the support shaft 20. The pedal member 28 has the pedal pad 18 formed integrally at its lower end. The booster rod 25 is connected to the pivotal member 26. Usually, the pivotal member 26 and the pedal member 28 are pivoted as a unit about the support shaft 20. A return spring 30 in the form of a tension coil spring is interposed between the bracket 14 and the pedal member 28, for biasing the pedal member 28 such that the brake pedal 16 is biased by a biasing force of the return spring 30 in the counterclockwise direction about the support shaft 20, toward the non-operated position. Namely, when the brake pedal 16 is depressed at its pedal pad 18 to push the booster rod 25, the brake pedal 16 is pivoted clockwise about the support shaft 20 from the non-operated position, against a force of resistance to this clockwise motion of the brake pedal 16, which force is produced by the return spring 20 whose biasing force acts on the brake pedal 16 as a moment causing the brake pedal 16 to be pivoted in the counterclockwise direction about the support shaft 20. This force of resistance will be hereinafter referred to as "depression resistance force". When the brake pedal 16 is released, that is, when an operating force acting on the brake pedal 16 is removed, the brake pedal 16 is pivoted about the support shaft 20 in the counterclockwise direction under the biasing action of the return spring 20, and is held at the non-operated position with the depression resistance force acting thereon.

The non-operated position of the brake pedal 16 (more precisely, the non-operated position of the pivotal member 26) is determined by a suitable stop device (not shown) or by a distance of extension of the booster rod 25 from the brake booster 24.

Each of the pivotal and pedal members 26, 28 of the brake pedal 16 is a generally planar member (except the pedal pad 18) whose plane is substantially perpendicular to the axis of the support shaft 20 and substantially parallel to the longitudinal direction of the vehicle, so that the planes of the pivotal and pedal members 26, 28 are substantially vertical planes (parallel to the plane of the side elevational view of FIG. 1). The pedal member 28 is movable relative to the pivotal member 26 in a substantially vertical sliding plane parallel to their planes indicated above, so that the non-operated position of the pedal pad 18 of the pedal member 26 is movable or adjustable in the longitudinal direction of the vehicle, to a desired position selected between a fully advanced or forwardest position indicated by solid line in FIG. 1 and a fully retracted or rearmost position indicated by broken line in FIG. 1.

Figure 2:
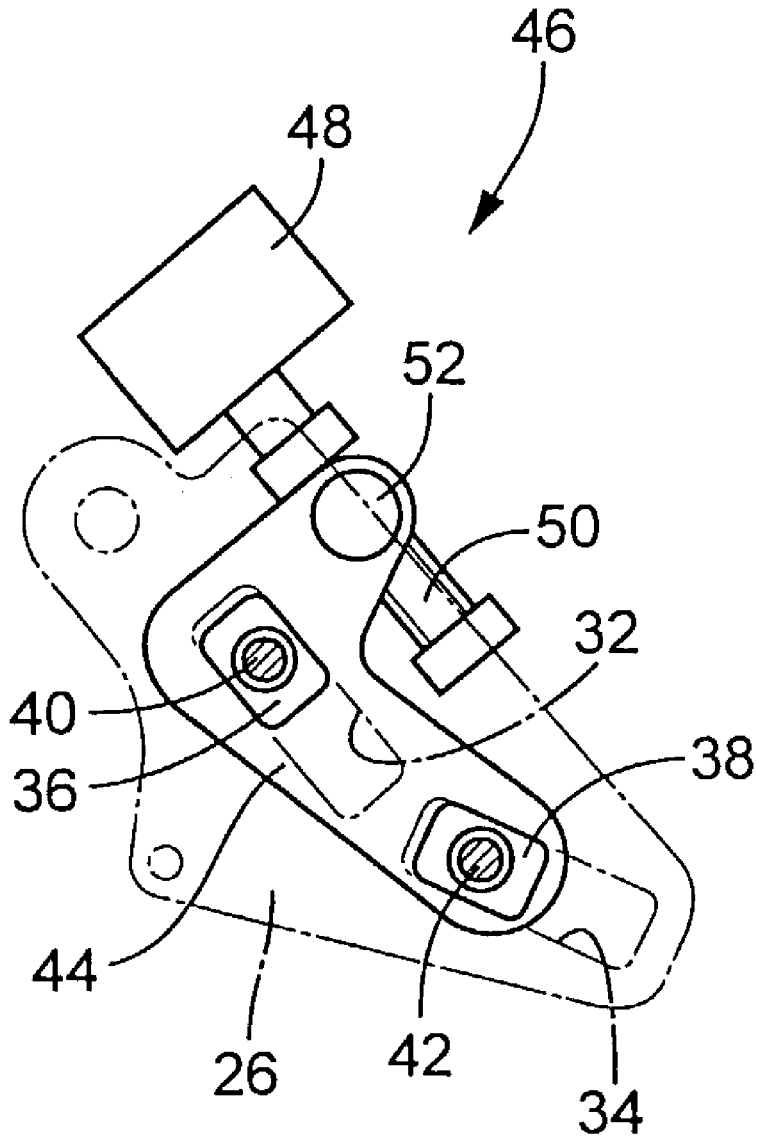
FIG. 2 is a cross sectional view showing an arrangement which permits a pedal member of a brake pedal to be moved relative to a pivotal member of the brake pedal, in the brake pedal device of FIG. 1.

As shown in FIG. 2, the pivotal member 26 has straight guides in the form of two straight elongate slots 32, 34 formed therethrough, while the pedal member 28 are provided with two guide pieces 36, 38 which are held in engagement with the respective two elongate slots 32, 34 and are slidably and linearly movable within the respective elongate slots 32, 34, so that the pedal member 28 is movable relative to the pivotal member 26 with the sliding movements of the guide pieces 36, 38 within the respective elongate slots 32, 34, whereby the non-operated position of the pedal pad 18 at the lower end of the pedal member 28 is adjustable or movable in the longitudinal direction of the vehicle. Each of the two guide pieces 36, 38 is a rectangular member having a width substantially equal to the width of the straight elongate slots 32, 34, so that each guide piece 36, 38 is linearly guided by the opposite surfaces of the corresponding elongate slot 32, 34, in the longitudinal direction of the elongate slot 32, 34. The pedal member 28 is provided with two support pins 40, 42 fixed thereto such that the support pins 40, 42 extend in a direction perpendicular to the above-indicated sliding plane in which the pivotal and pedal members 26, 28 are movable relative to each other. The two guide pieces 36, 38 are supported by the respective support pins 40, 42 such that the guide pieces 36, 38 are pivotable about the respective support pins 40, 42. It will be understood that the elongate slots 32, 34 and the guide pieces 36, 38 cooperate to constitute a guiding device for guiding a relative movement of the pivotal and pedal members 26, 28.

A connecting plate 44 is fixed to the support pins 40, 42 such that the guide pieces 36, 38 and a part of the pivotal member 26 in which the elongate slots 32, 34 are formed are sandwiched by and between the connecting plate 44 and the pedal member 28. The brake pedal device 10 includes an adjusting device 46 which connects the connecting plate 44 and the pivotal member 26 of the brake pedal 16. The adjusting device 46 includes an electric motor 48 supported by the pivotal member 26, a feedscrew 50 rotated about its axis by the electric motor 48, and a nut member 52 which is supported by the connecting plate 44 and which is held in engagement with the feedscrew 50. The electric motor 48 is operated to make a rotational movement in either clockwise or counterclockwise direction by the operator of the automotive vehicle through a suitable switching device. The electric motor 48 and the nut member 52 are disposed on the pivotal member 26 and the connecting plate 44, respectively, such that the electric motor 48 and the nut member 52 are pivotable about respective axes perpendicular to the above-indicated sliding plane (parallel to the plane of FIG. 2). When the electric motor 48 is operated, the nut member 52 is moved by the rotating feedscrew 50 in the axial direction of the feedscrew 50, so that the connecting plate 44 is moved to move the pedal member 28 while the movement of the pedal member 28 relative to the pivotal member 26 is guided by the linear sliding movements of the guide pieces 36, 38 within the respective elongate slots 32, 34. The electric motor 48 is turned off when the pedal pad 18 of the pedal member 28 moved relative to the pivotal member 26 has been moved to the desired non-operated position.

The return spring 30 is fixed at its opposite fixing end portions 54, 56 to the bracket 14 and the pedal member 28, respectively. In the present brake pedal device 10, the positions of these fixing end portions 54, 56 relative to the bracket 14 and the pedal member 28 are determined so as to substantially prevent or at least reduce a change of a lever length L of the brake pedal 16, which change would otherwise take place as the pedal member 28 is moved relative to the pivotal member 26 by the adjusting device 46 described above. The lever length L is a distance between the pedal pad 18 and the support shaft 20. Namely, the brake pedal 16 would have different values of the lever length L at different non-operated positions of the pedal pad 18, if the positions of the fixing end portions 54, 56 were not determined according to the principle of the present invention. The movement of the pedal member 28 relative to the pivotal member 26 would also cause a change of the position of the gravity center of the brake pedal 16. Accordingly, an adjustment of the non-operated position of the pedal pad 18 by moving the pedal member 28 relative to the pivotal member 26 would cause a change of the depression resistance force F which is produced by the return spring 30 and which acts on the brake pedal 16. To reduce this possible change of the depression resistance force F, the positions of the fixing end portions 54, 56 of the return spring 30 in engagement with the bracket 14 and the pedal member 28 are determined so as to satisfy the following equations (1)–(4):

$$F1 \times L1 = G \times S1 - f1 \times R1 \quad (1)$$

$$F1 = (G \times S1 - f1 \times R1)/L1 \quad (2)$$

$$F2 \times L2 = G \times S2 - f2 \times R2 \quad (3)$$

$$F2 = (G \times S2 - f2 \times R2)/L2 \quad (4)$$

In the above equations (1)–(4), "F1", "L1", "S1", "G", "R1", "f1", "F2", "L2", "S2", "R2" and "f2" represent the following parameters:

F1=depression resistance force of the brake pedal 16 when the pedal pad 18 is located at the fully advanced non-operated position indicated by solid line in FIG. 1;

L1=lever length of the brake pedal 16 when the pedal pad 18 is located at the fully advanced non-operated position;

S1=distance between the support shaft 20 and the position of the gravity center when the pedal pad 18 is located at the fully advanced non-operated position;

G=load acting on the brake pedal 16;

R1=length of an arm of a moment produced by the return spring 30 so as to bias the brake pedal 16 toward the non-operated position when the pedal pad 18 is located at the fully advanced non-operated position;

f1=initial biasing force of the return spring 30 when the pedal pad 18 is located at the fully advanced non-operated position;

F2=depression resistance force of the brake pedal 16 when the pedal pad 18 is located at the fully retracted non-operated position indicated by broken line in FIG. 1;

L2=lever length of the brake pedal 16 when the pedal pad 18 is located at the fully retracted non-operated position;

S2=distance between the support shaft 20 and the position of the gravity center when the pedal pad 18 is located at the fully retracted non-operated position;

R2=length of an arm of a moment produced by the return spring 30 so as to bias the brake pedal 16 toward the non-operated position when the pedal pad 18 is located at the fully retracted non-operated position;

f2=initial biasing force of the return spring 30 when the pedal pad 18 is located at the fully retracted non-operated position.

The lengths R1, R2 are distances between the return spring 30 and the axis of the support shaft 20 in a direction perpendicular to the direction in which the return spring 30 biases the brake pedal 16.

The depression resistance force F1 when the pedal pad 18 is located at the fully advanced non-operated position is represented by the above equation (2), while the depression resistance force F2 when the pedal pad 18 is located at the fully retracted position is represented by the above equation (4).

Since the distance S1 is almost equal to the distance S2 and since the lever length L2 is larger than the lever length L1, a difference between the depression resistance forces F1 and F2 can be reduced by determining the initial biasing forces f1 and f2 and the moment arm lengths R1 and R2 such that a product (f2×R2) is larger than a product (f1×R1). The products (f1×R1) and (f2×R2) represent the moments produced by the return spring 30 to bias the brake pedal 16 toward the non-operated position. The initial biasing forces f1 and f2 may be determined by a constant k, and effective lengths X1 and X2 of the return spring 30 when the pedal pad 18 are located at the fully advanced and retracted positions.

Figure 3:
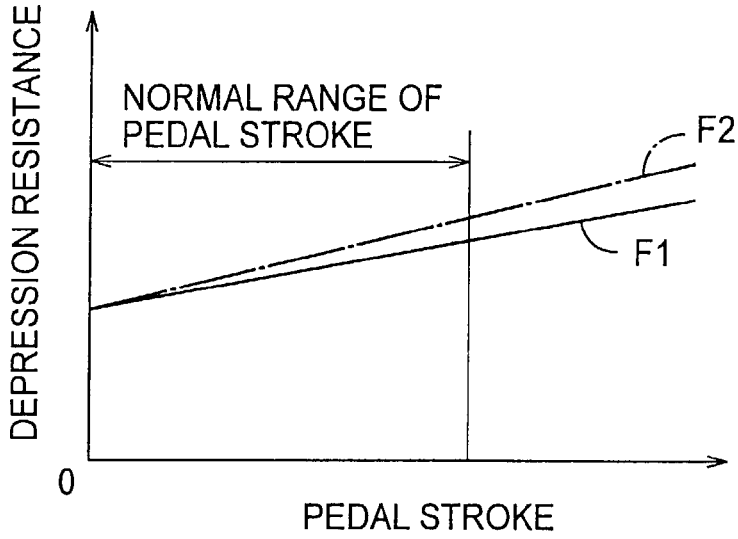
FIG. 3 is a view indicating two relationships between a depression resistance and an operating stroke of the brake pedal, when the pedal member is placed at respective fully advanced and retracted non-operated positions, in the pedal device of FIG. 1.
Figure 4:
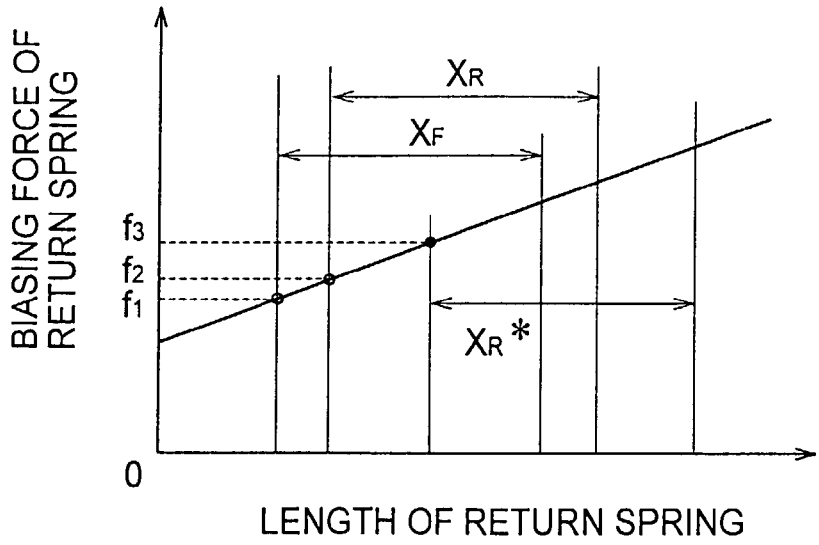
FIG. 4 is a view indicating a relationship between a biasing force of a return spring used to give the pedal member the depression resistance and a length of the return spring when the pedal member is depressed.

The product (f2×R2) can be made larger than the product (f1×R1) by determining the positions of the fixing end portions 54, 56 of the return spring 30 such that the force f2 is larger than the force f1, or such that the length R2 is larger than the length R1. In the present embodiment, the length R2 is made larger than the length R1, with a rearward movement (rightward movement as seen in FIG. 1) of the fixing end portion 56, as indicated by a one-dot chain line in FIG. 1, when the non-operated position of the pedal pad 18 is changed from the fully advanced position to the fully retracted position, as a result of a movement of the pedal member 28 relative to the pivotal member 26. In this case, the depression resistance force F2 can be made substantially equal to the depression resistance force F1, without having to make the initial biasing force f2 considerably larger than the initial biasing force f1. FIG. 3 shows changes of the depression resistance forces F1 and F2 of the brake pedal 16 with a change of the operating stroke of the pedal member 26. It will be understood from FIG. 3 that the depression resistance forces F1 and F2 are almost equal to each other over the entirety of a normal range of the operating stroke. Namely, the depression resistance force F of the brake pedal 16 is held substantially constant irrespective of the presently selected non-operated position of the pedal pad 18 (of the pedal member 28), as long as the operating stroke of the brake pedal 16 is not larger than the upper limit of the normal range. FIG. 4 shows operational ranges of the return spring 80. Specifically, when the pedal pad 18 is located at the fully advanced position, the length of the return spring 30 changes within the operational range $X_F$ as it is stretched upon an operation of a brake pedal 16, in a similar manner, when the pedal pad 18 is located at the fully retracted position, the length of the spring 30 changes within the operational range $X_R$. It is understood from FIG. 4 that the operational range $X_R$ is located on slightly higher-biasing-force side than the operational range $X_F$, and the length of the return spring 30 is stretched slightly longer as the non-operated position of the pedal pad 18 changes from the fully advanced position to the fully retracted position. However, in comparison to the range $X_R$* where the depression resistance forces F1 and F2 are managed to be almost equal to each other by increasing the biasing force of the return spring 30 without changing the moment arm length R, the operational range $X_R$ is located on lower-biasing-force side, and the length of the return spring 30 at non-operated position is not stretched as much as the spring at non-operated position in the operational range $X_R$*.

In the brake pedal device 10 constructed according to the present embodiment as described above, the return spring 30 is fixed at its opposite fixing end portions 54, 56 to the bracket 14 and the pedal member 28, respectively, and the positions of the fixing end portions 54, 56 relative to the bracket 14 and the pedal member 28 are determined such that the moment arm length R increases with an increase of the lever length L of the brake pedal 16, so that the depression resistance force F which is produced by the return spring 30 and which acts on the brake pedal 16 (pedal member 28) is kept substantially constant irrespective of an adjustment of the non-operated position of the pedal pad 18 (pedal member 28) by the adjusting device 46 between the fully retracted and advanced positions. Accordingly, the present brake pedal device 10 does not suffer from an undesirable change of the depression resistance force F, which would be felt by the operator of the brake pedal 16.

Further, a structure or mechanism to maintain the depression resistance force F at a substantially constant value irrespective of an adjustment of the non-operated position of the pedal pad 18 of the pedal member 28 is simple in construction with a reduced weight and economical to manufacture. That is, the mechanism is obtained by simply positioning the opposite fixing end portions 54, 56 of the return spring 30 relative to the bracket 14 and the pedal member 28, respectively, such that the arm length R of the moment produced by the return spring 30 to bias the pedal member 28 toward the non-operated position changes so as to reduce the amount of change of the depression resistance force F. In addition, the change of the moment arm length R reduces the amount of change of the initial biasing force f of the return spring 30, and is therefore effective to reduce the amount of increase of a resistance to a pivotal motion of the pedal member 28 due to an increase in the initial biasing force f, so that the weight and cost of manufacture of the adjusting device 46 provided to move the pedal member 28 relative to the pivotal member 26 can be significantly reduced. Further, the biasing force of the return spring 30 can be held smaller (within the normal ranges $X_F$ and $X_R$) than that where the moment arm lengths R1 and R2 are made equal to each other, that is, than the biasing force within the normal range $X_R$*. Accordingly, the amounts of wear of the related components or portions such as the fixing end portions 54, 56 are reduced, so that their required mechanical strength is reduced, and their durability is increased.

While the presently preferred embodiment of this invention has been described in detail by reference to the drawings, for illustrative purpose only, it is to be understood that the present invention may be embodied with various other changes, modifications and improvements, which may occur to those skilled in the art, in the light of the technical teachings of the present invention which have been described.

What is claimed is:

1. An adjustable pedal device to be installed on an automotive vehicle comprising:

a support shaft fixedly disposed on a bracket;

a pedal including a pivotal member and a pedal member, said pivotal member being supported by said support shaft such that said pivotal member is pivotable about said support shaft, said pedal member being disposed movably relative to said pivotal member to a selected one of a plurality of relative positions and having at a lower end thereof an operating portion at which said pedal member is operated so that said pedal member and said pivotal member are pivoted together about said support shaft; and a return spring interposed between said bracket and said pedal member and biasing said pedal member so as to pivot said pedal about said support shaft in a first direction toward a non-operated position of said pedal, said return spring producing a force of resistance to a pivotal motion of said pedal in a second direction away from said non-operated position when said pedal is operated at said operating portion, and wherein said return spring is fixed at opposite fixing end portions to said bracket and said pedal member, respectively, positions of said opposite fixing end portions of said return spring relative to said bracket and said pedal member being determined such that a length of a moment arm produced by said return spring to bias said pedal in said first direction increases with an increase of a lever length of said pedal as a result of a movement of said pedal member relative to said pivotal member, to change said non-operated position of said pedal in a longitudinal direction of the automotive vehicle, whereby an amount of change of said force of resistance as a result of a change of said non-operated position in said longitudinal direction is reduced, said lever length being a distance between an axis of said support shaft and said operating portion of said pedal member, wherein said length of the moment arm changes with a movement of the fixing end portion of said return spring fixed to said pedal member, in said longitudinal direction of the automotive vehicle as said pedal member is moved relative to said pivotal member to change said non-operated position of said pedal.

2. An adjustable pedal device according to claim 1, wherein said return spring is a tension coil spring.

3. An adjustable pedal device according to claim 1, wherein said positions of said opposite fixing end portions of said return spring are determined such that the length of the arm of said moment produced by said return spring changes with a change of a length of said return spring, so a to hold said force of resistance substantially constant irrespective of a movement of said pedal member relative to said pivotal member.

4. An adjustable pedal device according to claim 1, further comprising:

a guiding device operable to guide a movement of said pedal member relative to said pivotal member along a predetermined path; and an adjusting device interposed between said pedal member and said pivotal member and operable to move said pedal member relative to said pivotal member along said predetermined path, for establishing a desired relative position between said pedal member and said pivotal member, while said pedal member is guided by said guiding device.

5. An adjustable pedal device according to claim 4, wherein said guiding device includes at least one guide piece each which is fixed to said pivotal member and said pedal member such that said each guide piece is slidably movable within an elongate slot formed through the other of said pivotal member and said pedal member.

6. An adjustable pedal device according to claim 4, wherein said adjusting device includes an electric motor fixed to one of said pivotal member and said pedal member, a feedscrew connected to and rotated by said electric motor, and a nut member engaging said feedscrew and fixed to the other of said pivotal member and said pedal member.

7. An adjustable pedal device according to claim 1, which is to be installed on the automotive vehicle such that an axis of said support shaft is substantially parallel to a lateral direction of the automotive vehicle, and such that said pedal member is movable relative to said pivotal member, in a substantially vertical sliding plane substantially parallel to the longitudinal direction of the automotive vehicle, so that said operating portion of said pedal member is moved in said longitudinal direction.

8. An adjustable pedal device according to claim 7, wherein said positions of said opposite fixing end portions of said return spring relative to said bracket and said pedal member are determined such that the length of the moment arm produced by said return spring increases with the increase of the lever length of said pedal as a result of a rearward movement of said operating portion of said pedal member toward a rear side of the automotive vehicle, which rearward movement is caused by the movement of said pedal member relative to said pivotal member.

* * * * *

UNITED STATES PATENT AND TRADEMARK OFFICE

CERTIFICATE OF CORRECTION

PATENT NO. : 7,069,810 B2
APPLICATION NO. : 10/394207
DATED : July 4, 2006
INVENTOR(S) : Hayashihara It is certified that error appears in the above-identified patent and that said Letters Patent is hereby corrected as shown below:

Title Page, item [73], “co.,” should read --Co.,--.

Signed and Sealed this

Nineteenth Day of December, 2006

JON W. DUDAS
*Director of the United States Patent and Trademark Office*